United States Patent [19]

Fuller et al.

[11] Patent Number: 4,946,164

[45] Date of Patent: Aug. 7, 1990

[54] SUSPENDED BALL WATER TOY

[75] Inventors: Mark W. Fuller, Studio City; Alan S. Robinson, El Monte; John Werner, Sunland, all of Calif.

[73] Assignee: Wet Enterprises, Inc., Universal City, Calif.

[21] Appl. No.: 152,746

[22] Filed: Feb. 5, 1988

[51] Int. Cl.[5] ..... A63B 69/00

[52] U.S. Cl. ..... 273/26 R; 446/186

[58] Field of Search ..... 273/26 R, 26 D; 239/17, 239/20, 206, 211; 272/1 B, 8 R; 446/199, 176, 184, 185, 166, 187, 186

[56] References Cited

U.S. PATENT DOCUMENTS 3,377,741 4/1968 Ryan ..... 446/186
3,856,300 12/1974 Payne ..... 273/25
4,564,195 1/1986 McClure ..... 273/26 R
4,575,080 3/1986 Miles ..... 273/26 R

*Primary Examiner*—T. Brown

[57] ABSTRACT

The present invention comprises a base coupled to a water source, the base outputting a stream of water for supporting a toy ball in mid air. The base includes filtering device for substantially eliminating turbulence from the water stream so that it is substantially laminar. The flowing stream contacts a toy ball and lifts it into a position of equilibrium where the upward force of the stream balances the downward force of gravity acting on the ball so that the ball is suspended in mid air. The flowing water clings to the surface of the ball and generates a force tending to center the ball in this supporting stream. If the ball becomes off center, an unequal force on the side of the ball furthest from the center of the stream will force the ball back to the stream center.

9 Claims, 3 Drawing Sheets

SUSPENDED BALL WATER TOY

BACKGROUND OF THE INVENTION

1. FIELD OF THE INVENTION

This invention relates to the field of water toys and in particular to a mechanism for supporting a toy ball on a stream of water.

2. BACKGROUND ART

The present invention is directed to a device for supporting a toy ball on a fluid stream, such as water, for use as an amusement or game playing apparatus. In its preferred application, the present invention is used as a "baseball" type game. Because of the use of flowing streams of water, the present invention is particularly enjoyable in hot weather and hot climates.

In the past, several devices have been used to support a ball or other object on a flowing fluid stream. In Neveling, U.S. Pat. No. 2,785,895, a toy fountain is described in which a light weight ball is held in a suspended spinning position at the side of a stream of water. In Neveling, a stream of water is generated in an elongated clear vertical member so that the supported ball may be viewed easily while limiting access to the ball.

Damm, U.S. Pat. No. 755,114 is directed to a fountain utilizing mercury as the liquid medium and illustrates the supporting of the ball on a vertical stream of mercury.

Stanley, U.S. Pat. No. 4,205,785 is directed to a water play toy in which a clown's hat comprising an inverted funnel with an impeller disposed in the top portion thereof is supported on a vertical stream of water and throws off a shower of droplets.

Evans, U.S. Pat. No. 3297324 illustrates the use of an air stream to support a light weight ball.

The present invention provides a water toy combining the well known participatory enjoyment of baseball with the cooling of water and water sprays.

In another aspect, the present invention provides a stationary base member for projecting a substantially laminar stream of water upward for supporting a toy ball. An adjustable valve is connected to a water supply means for controlling the pressure of the laminar output stream of the base member and correspondingly controlling the supportive height of the toy ball.

In still another aspect of the invention, the supporting stream of water may be used as a "tee" where upon the player may strike the ball from the "tee" with a toy bat. When striking the ball, a spray of water is produced adding the aspect of water play to the game.

In yet another aspect of the present invention, a controllable valve is provided where upon a player may adjust the height of the supporting stream so as to make it more difficult for a second player to strike the toy ball with a toy bat. In this manner, a game of water baseball may be enjoyed wherein the player controlling the valve is the "pitcher" and pitches to the batter by adjusting the height of the toy ball supported on the stream.

SUMMARY OF THE PRESENT INVENTION

The present invention comprises a base coupled to a water source, the base outputting a stream of water for supporting a toy ball in mid air. The base includes filtering means for substantially eliminating turbulence from the water stream so that it is substantially laminar. The laminar flowing stream contacts a toy ball and lifts it into a position of equilibrium where the upward force of the stream balances the downward force of gravity acting on the ball so that the ball is suspended in mid air. The flowing water clings to the surface of the ball and generates a force tending to center the ball in this supporting stream. If the ball becomes off center, an unequal force on the side of the ball furthest from the center of the stream will force the ball back to the stream center.

An open basket is coupled to the base and includes an opening in the center thereof for passage of the supporting stream. If the stream is interrupted, dropping the ball, or if the ball is otherwise caused to fall off the supporting stream, it will generally be caught in the basket and then roll to the center thereof, in proper position for lifting by the supporting stream. The basket comprises an open structure so that water does not collect in the basket but rather falls through to the ground.

A valve device is coupled to the base through a hose and is used to interrupt the flow of water from the water source to the base, correspondingly controlling the supporting stream. The valve may be spring biased so that it is in either the on or off position when at rest. By activating the valve, the presence and/or height of the supporting stream may be controlled.

A toy bat may be utilized to strike the ball from the supporting stream of water as if from a "tee". In this manner, the device of the present invention may be utilized in a game of "baseball". By manipulating the valve means, a "pitcher" may control the height of the supporting stream, making the toy ball more difficult to hit by a batter.

DETAILED DESCRIPTION OF THE PRESENT INVENTION

A water toy for providing a controllable supporting stream for supporting a toy ball is described. In the following description, numerous specific details are set forth in order to provide a more thorough description of the present invention. It is obvious, however, to one skilled in the art, that the present invention may be practiced without these specific details. In other instances, well known structures have not been described in detail in order not to unnecessarily obscure the present invention.

Figure 1:
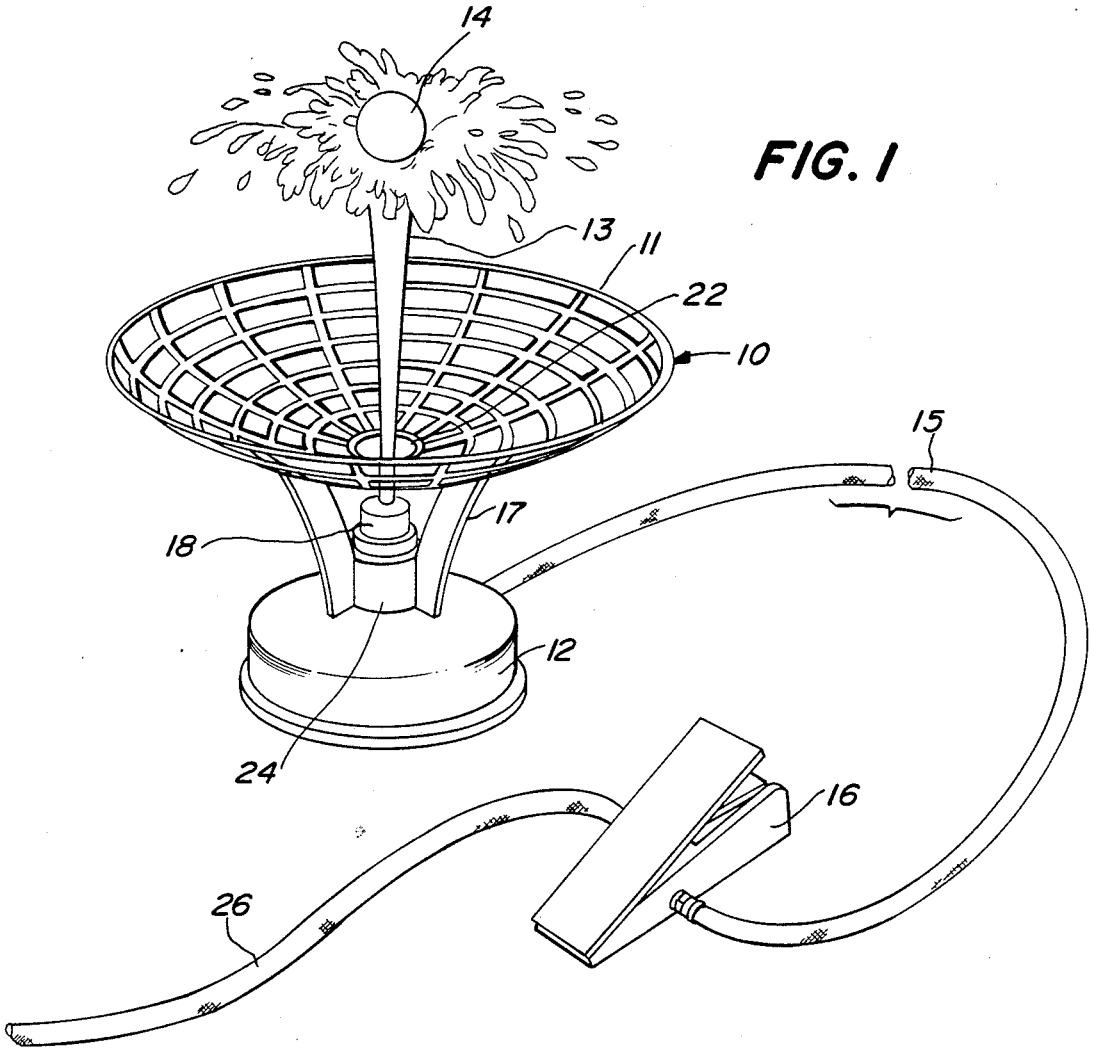
FIG. 1 is a prospective view of the preferred embodiment of the present invention illustrating a toy ball supported on a flowing vertical stream.

Referring to FIG. 1, a preferred embodiment of the present invention is illustrated. A hose 26, such as a garden hose, connects the water source to a valve 16. A second hose 15 couples the valve to a water chamber 12 of the base 10. Water from the chamber 12 is forced through laminar filter 24 and nozzle 18 producing output stream 13. As shown in FIG. 1, output stream 13 is used to support a toy ball 14 suspended at the top of the stream. An open mesh basket 11 is concentric with and includes an opening for output stream 13. The basket 11 is coupled to chamber 12 through support member 17.

Still referring to FIG. 1, the stream 13 supports the ball by exerting an upward force on the ball 14 at least equal to the downward force exerted on the toy ball 14 by gravity. Water striking the bottom of the ball 14 causes a sheet of water to flow around the ball. Because water is flowing around the ball from all sides, a collision of these opposing streams causes the splashing effect illustrated in FIG. 1.

In order to accurately center and hold the ball in position, the water flowing around the ball must be substantially free of turbulence. However, perfect laminar flow is not required. The flow of water around the ball 14 generates a centering force. The change in direction of the flow of water around the ball exerts a force on the ball. Because the water is coming from all sides, the force is equal and tends to hold the ball in position. If the ball becomes decentered, more water flows over the side of the ball opposite the direction of displacement and less water flows over the side of the ball in the direction of the displacement. Given a spherical ball, the force exerted by the flowing streams is proportional to the quantity of the flow. Therefore, the unbalanced forces tend to return the ball to the center of the stream.

Three criteria must be met in order to balance the ball on a stream of water. Namely, the mass flow rate and velocity of the supporting stream must be sufficient both to lift the water itself and to provide sufficient momentum to the ball at the desired height. Secondly, the character of the stream must be substantially laminar, so that the stream will attach itself to the ball rather than splashing off the surface. Finally, the surface of the ball must be smooth enough so that the stream will remain attached to the ball over the entire surface of the ball. Correspondingly, the ball must be small enough so that the volume of water contained in the stream can envelope the ball in a sheet.

For typical household water supply systems, the mass flow rate and velocity of an available water stream is substantially fixed. Therefore, the weight of the ball is the limiting factor in determining whether a ball may be supported on a stream. Thus, the present invention contemplates a light weight inflated ball. In the preferred embodiment, an inflated vinyl ball of approximately three to three and one half inches in diameter is utilized. However, the ball can be anywhere from 1 and ½ inches to six inches in diameter without departing from the scope of the present invention. Further, larger balls may be utilized by increasing the size of the supporting stream 13 provided that sufficient water pressure is available. In addition to inflated balls, hollow rigid plastic balls may be utilized as well. The surface of the ball should be free of pronounced protrusions so that easy flow of an enveloping stream of water may be achieved.

The typical pressure of household water supply systems is in the range of 35 to 75 pounds per square inch. The typical flow rate of a household supply system is in the range of 4 to 15 gallons per minute. Therefore, the weight of the ball should be in the range of 30 grams to 60 grams so that it may be adequately supported in the proposed invention. However, other weight balls may be utilized if sufficient pressure and flow rate is available.

The substantially laminar flow output stream 13 is generated in the base 11. The receiving (or stilling) chamber 12 receives the water, and provides it to a laminar filter or flow stabilizing means 24, where it exits through nozzle 18.

The receiving chamber serves to reduce the velocity of the water prior to entering the filter means. In order to reduce the rotational component of the incoming stream of water and the receiving chamber 12, it is recommended that the input hose 15 be coupled to the chamber 12 with a radially disposed fitting. A tangentially disposed fitting may be utilized if means are provided to reduce the rotational component in the filter means of the present invention. In the preferred embodiment, the receiving chamber 12 has a substantially flat bottom so that when the base 11 is placed on a substantially level surface, the output stream 13 will be properly oriented for supporting a toy ball indefinitely.

The laminar filter 18 of the present invention consists of open cell polyether foam. In the preferred embodiment, the foam has a porosity of approximately 20 pores per inch. The foam is retained in the base by means of a metal screen. The screen also prevents the foam from being extruded into the nozzle due to the water pressure drop across the foam. In the preferred embodiment of the present invention, the metal screen is stainless steel of approximately 20 mesh. Although polyether foam is utilized in the preferred embodiment of the present invention for the laminar filter, any suitable element which acts to stabilize the flow of the stream of water by flattening the velocity profile, removing rotation and suppressing turbulence may be utilized. Other filters having a parality of narrow passages such that the length of the flow path through the filter is long in relation to the pore sizes of material may be utilized. In the preferred embodiment, the length of the flow path is at least 20 times the diameter of the passages. For longer life, the filter material should be impervious to attack and degradation by tap water and also be able to withstand the water velocities utilized in the invention.

The nozzle must be such that it does not introduce turbulence, rotation or a variable velocity profile into the output stream of water. Therefore, the walls of the nozzle should be smooth and substantially circular with a continuously decreasing cross sectional area. The orifice of the nozzle must be such that typical household water pressures and flow rates can be used to create a stream to support or stabilize the ball. In the preferred embodiment of the present invention, the orifice of the nozzle 18 is approximately ⅜ inch in diameter requiring a flow rate of at least 5 gallons per minute to drive.

The connecting hoses 15 and 26 should be such that the maximum flow rate of the water source may be conducted without a large pressure drop. Elastic and soft vinyl hoses should not be used. An inelastic hard vinyl or reinforced rubber or soft vinyl hose is utilized in the preferred embodiment. This allows relatively responsive control of the water stream 13 by use of the valve 16.

Figure 3:
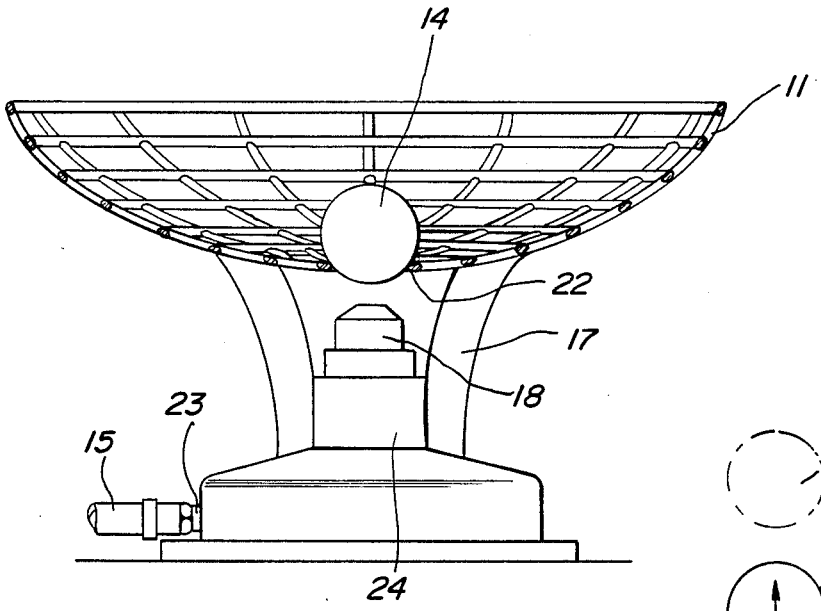
FIG. 3 is a side view of the base member of the present invention.

Referring to FIG. 3, the base 10 without the water stream is illustrated. The dish shaped basket includes a bottom opening 22 such that the ball 14 comes to rest in the opening directly above the outlet of nozzle 18. The basket 11 is of an open mesh design so that water does not collect in the basket, but rather falls through the basket into the ground surrounding the base. As previously discussed, the inlet coupling 23 to the receiving chamber 12 is axially disposed with respect to the base.

Figure 4:
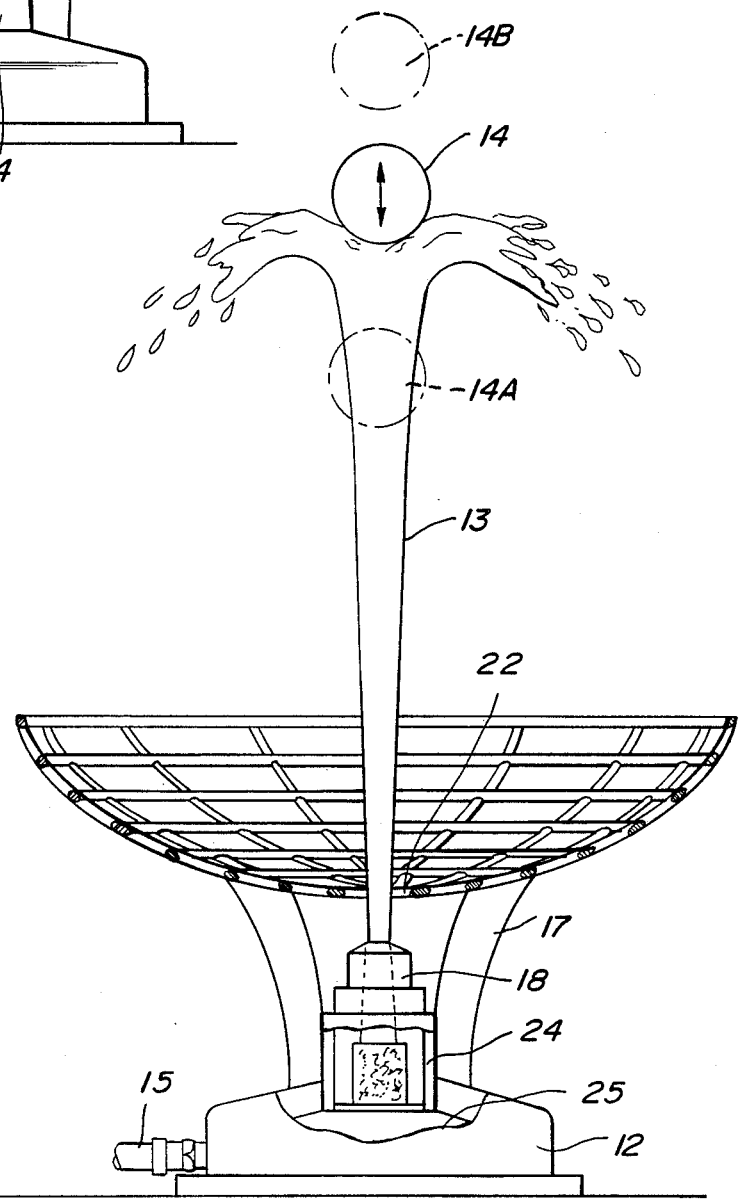
FIG. 4 is a side view of the base of the present invention showing a water stream supporting a toy ball.

Referring now to FIG. 4, the base 10 is shown with the outlet stream 13 supporting a toy ball 14. By controlling the flow rate by means of the valve of the input water to the base 10, the height of the ball 14 may be adjusted. For example, by decreasing the flow rate, the ball 14 may drop to position 14A shown in phantom in FIG. 3. By increasing the flow rate, the ball 14 may rise to position 14B shown in phantom in FIG. 4. As shown, the opening 22 of basket 11 is large enough so that stream 13 does not contact the sides of the basket 11.

Figure 5:
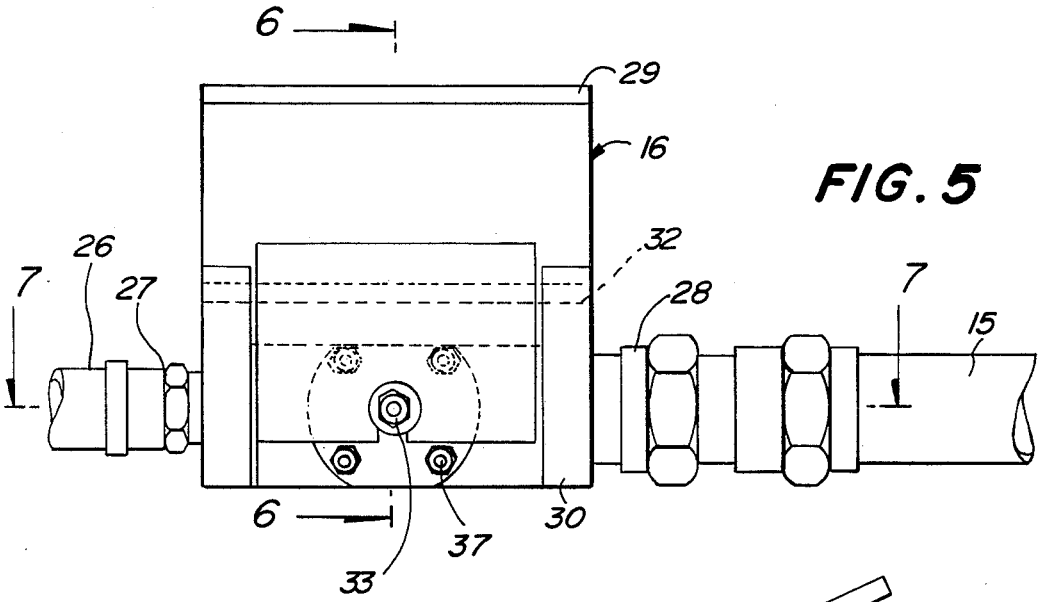
FIG. 5 is a front view of the valve means of the preferred embodiment of the present invention.
Figure 6:
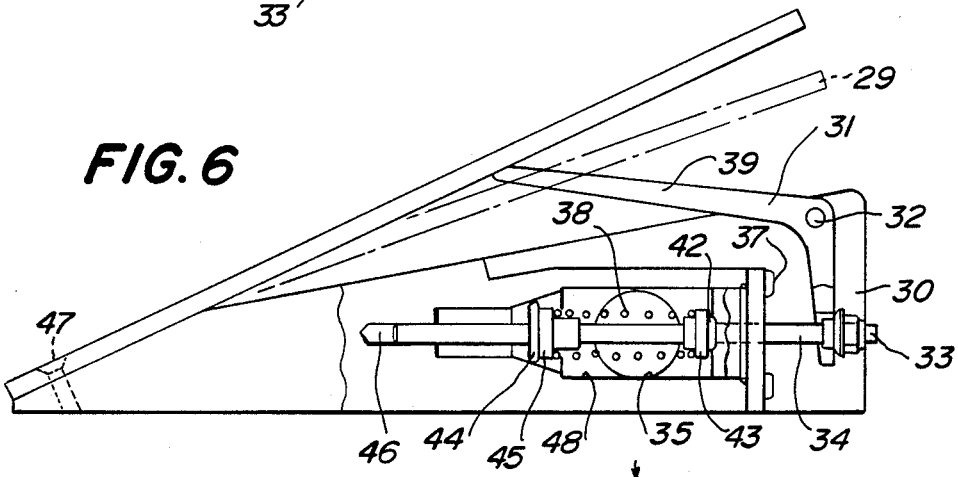
FIG. 6 is a side cut away view of the valve means of FIG. 5.
Figure 7:
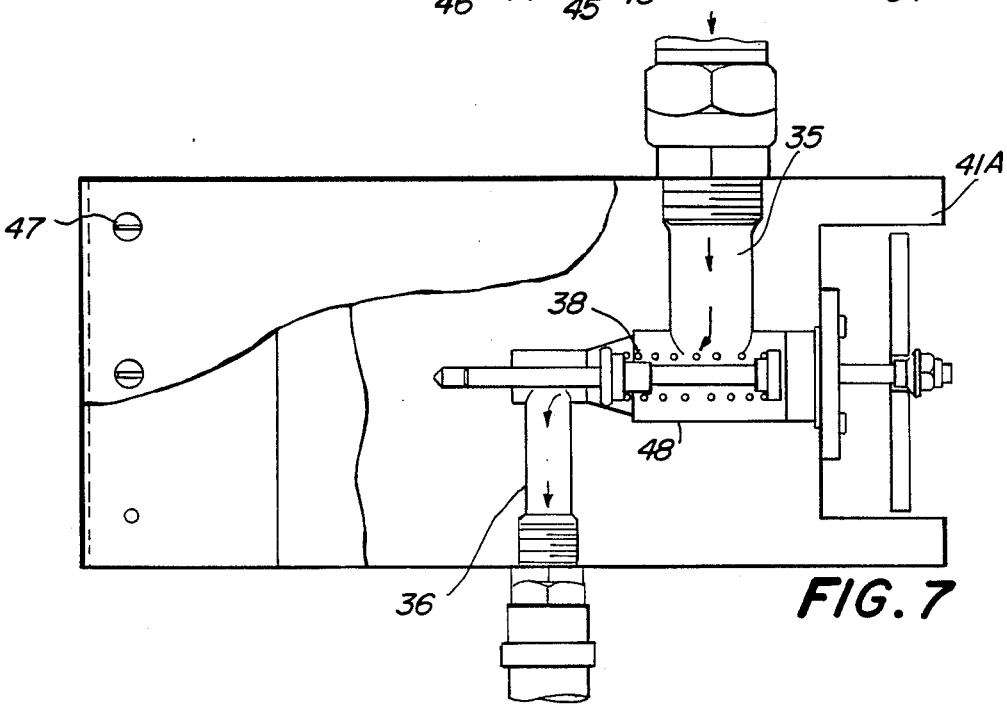
FIG. 7 is a top cut away view of the valve means of FIG. 6.

The valve of the present invention is illustrated in FIGS. 5–7. The valve consists generally of an input port 35 and outlet port 36. Separating the inlet and outlet port is a piston chamber 48 with a flow restricting piston which may be selectably positioned by a lever arm. In the preferred embodiment of the present invention, the valve comprises a spring bias lever used to control the position of the piston. The lever is positioned by means of a pedal which may be operated with a user's foot or hand.

Referring to FIG. 6, the lever arm 31 is coupled to the base 30 of the valve 16 at pivot point 32. Lever arm 31 has an upper member 39 abutting pedal 29 and a lower member 40 coupled to piston 34. Pedal 29 is pivotally coupled to base 30 for means of screw 47. As pedal 29 moves through arc 49 causing upper member 39 to rotate counter clockwise about pivot point 32. This in turn causes bottom member 40 of lever arm 31 to pull piston 34 such that seal member 44 is retracted from abutment with walls 49. This results in a flow passage being created between inlet port 35 and outlet port 36. The resultant flow through valve 30 causes laminar output stream 13 to be produced at base 12 of the present invention.

When pressure is released from pedal 29, the biasing effect of spring 38 urges piston 34 such that sealing member 44 is in abutment with wall 49 of the piston chamber 48. Correspondently, piston 34 urges lever arm 31 in a clockwise direction, causing pedal arm 29 to be raised upward through arc 49. When sealing member 44 abuts wall 49, a seal if formed preventing the flow of water between inlet port 35 and outlet port 36.

Piston 34 consists of a substantially cylindrical rod having a sealing member 44 at one end thereof. The sealing member 34 may be an elastic "O" ring so as to provide a positive seal when abutting angled wall 49 of piston chamber 48. The opposite end of piston 34 includes a retaining means 33 which in the preferred embodiment of the present invention comprises a bolt. Bolt 33 is such that it restrains bottom member 40 of lever arm 31 on piston 34. Piston 34 passes through restraining member 43 which includes sealing means 42 to prevent water in piston chamber 48 from leaking. Sealing means 42 may be a pliant sleeve or overing. Spring 38 abuts retaining means 43 and is disposed about piston 34. The other end of spring 38 abuts member 45 of piston 34 which is coupled to sealing member 44. The spring is such that it biases piston 34 so that the flow is prevented between input port 35 and output port 36. However, in another embodiment of the present invention, spring means 38 could be disposed such that it biases piston 34 in an "open" position such that there is a flow path between inlet port 35 and outlet port 36.

Referring to FIG. 5, piston 34 is disposed through plate 50 held in place by floor bolts 37. An opening is formed in plate 37 for exit of piston 34.

Referring to FIG. 7, inlet opening 35 may include a constant flow type valve to limit the flow rate of the water to a desired level. In the preferred embodiment, a Dole valve limiting the flow rate to approximately 5 gallons per minute is utilized. This eliminates an initial surge of water to the nozzle upon opening of the foot pedal valve. In this manner, more direct and linear control of the height of the ball may be achieved. Although a Dole valve or a Dole type valve is used in the preferred embodiment, any constant flow control valve may be utilized in the present invention without departing from the scope thereof.

Figure 2:
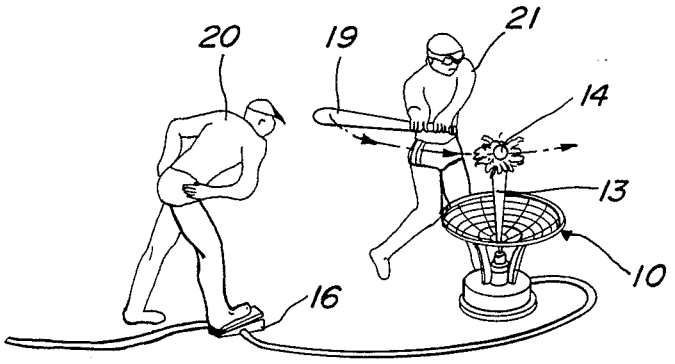
FIG. 2 illustrates the present invention as used in a baseball type game.

Referring now to FIG. 2, a particular application of the device of the present application is illustrated. As shown in FIG. 2, a "pitcher" 20 controls valve 16 through foot operation. A "batter" 21 wields a toy bat 19 waiting for the "pitch". If desired, the ball 14 may be at rest (water off) where upon the "pitcher", by activating valve 16 causes stream of water 13 to lift the ball 14 into position for hitting by the batter 21. In other instances, the ball 14 may be already supported by stream 13 whereupon the "pitcher" 20 manipulates the stream of water 13, making the ball 14 more difficult for the batter 21 to hit. Other than the unique way of "pitching" to the batter, the present invention may be utilized as part of an ordinary game of baseball.

We claim:

1. A play device comprising;

a toy ball;

a striking means;

a base having a nozzle means, and a coupling means in fluid communication with said nozzle means;

said nozzle means being a substantially laminar flow nozzle for outputting a substantially laminar flow stream of water when said coupling means is coupled to a source of water under pressure, said flow stream for supporting said toy ball when said flow stream is directed approximately vertically upward; said ball being supported on said flow stream for striking by a first player holding said striking means;

valve means for coupling in series between a source of water under pressure and said coupling means at a location substantially displaced from said nozzle means, said valve means being a means for controlling the flow of water from a source of water under pressure to said nozzle mans, and thus the height a toy ball will be supported output of said flow stream;

whereby said first player attempts to strike said toy ball from said flow stream and a second player attempts to manipulate the level of said toy ball and said flow stream to prevent said striking.

2. The device of claim 1 wherein said base further includes a basket means for catching said toy ball when displaced from said flow stream, said basket means having a depression therein for positioning said toy ball over said nozzle means.

3. The device of claim 2 wherein said basket includes a plurality of openings therein for draining of said fluid.

4. The device of claim 1 wherein said valve mean comprises a lever actuated piston disposed between an inlet opening receiving said fluid and an outlet opening, said lever actuated piston being controllably positioned between a first position for sealing said outlet opening from said opening and a second position for achieving a fluid connection between said inlet opening and said outlet opening.

5. The device of claim 4 wherein said valve means further includes a flow control valve coupled to said inlet opening for limiting the maximum flow rate of said fluid to a fixed level.

6. The play device of claim 1 wherein said valve means is a means for manual control by a player's foot.

7. A method for playing a water ball game comprising the steps of;

providing a nozzle for producing a substantially vertically upwardly directed laminar flow stream of water for supporting a toy ball on said flow stream;

providing a controllable valve means coupled between said nozzle and a source of water under pressure at a location substantially displaced from said nozzle means for control by a first player, said first player controlling the level of said flow stream and a toy ball supported thereon;

adjusting the level of said toy ball by said first play by adjusting said valve means so as to prevent said striking of said ball while a second player having a striking means attempts to strike said toy ball from said flow stream.

8. The method of claim 7 wherein said valve means further includes a flow control valve coupled to said inlet opening for limiting the maximum flow rate of said fluid to a fixed level.

9. The method of claim 7 wherein the level of the toy ball is adjusted by the first player by control thereby by the first player's foot.

* * * * *